United States Patent [19]

Jones et al.

[11] Patent Number: 4,591,397

[45] Date of Patent: May 27, 1986

[54] NON-CYANIDE SALT BATH AND PROCESS FOR CARBURIZATION OF FERROUS METALS AND ALLOYS

[75] Inventors: William C. Jones, Enfield, Conn.; Kenneth R. Britt, Easthampton, Mass.; Isaac L. Newell, Manchester, Conn.

[73] Assignee: Heatbath Corporation, Springfield, Mass.

[21] Appl. No.: 705,852

[22] Filed: Feb. 26, 1985

Related U.S. Application Data

[62] Division of Ser. No. 566,288, Dec. 28, 1983, abandoned.

[51] Int. Cl.[4] ..... C23C 9/10; C21D 1/48

[52] U.S. Cl. ..... 148/15.5; 148/19; 148/20; 148/27; 148/29; 148/31.8

[58] Field of Search ..... 148/15.5, 19, 20, 27, 148/29

[56] References Cited

U.S. PATENT DOCUMENTS 4,153,481 5/1979 Foreman et al. ..... 148/15.5

FOREIGN PATENT DOCUMENTS 2115444A 9/1983 United Kingdom .

*Primary Examiner*—Veronica O'Keefe

*Attorney, Agent, or Firm*—Morgan Finnegan Pine Foley & Lee

[57] ABSTRACT

A non-cyanide molten salt bath composition and process for the carburization of objects made of ferrous metals or alloys are provided. The composition comprises a molten salt mixture, at a temperature in the range of 900° C. to 1050° C., of an alkali metal chloride or a mixture of alkali metal chlorides; an activator consisting of an oxygen containing strontium or barium salt; and a graphite cover. The process comprises immersing the ferrous metal or alloy part in the molten mixture at a temperature in the range of 900° C. to 1050° C.

6 Claims, No Drawings

NON-CYANIDE SALT BATH AND PROCESS FOR CARBURIZATION OF FERROUS METALS AND ALLOYS

This application is a division of application Ser. No. 566,288 filed Dec. 28, 1983 now abandoned.

INTRODUCTION

The present invention relates to a non-cyanide molten salt bath composition and process for the carburization of objects made of ferrous metals or alloys. More particularly, the present invention relates to a non-cyanide molten salt bath comprising: alkali metal chloride, an oxygen containing strontium or barium salt, which can be calcined to the corresponding oxide, and a graphite cover. The process involves immersing ferrous metal parts in the bath at a temperature in the range of 900° C.–1050° C. for a period of time to achieve the desired result.

BACKGROUND OF THE INVENTION

Carburization of ferrous metal parts in molten salt baths has been known for many years. The conventional method involves using a substantial amount of a cyanide salt in a molten chloride bath. Although metal parts treated in the cyanide baths exhibit a high degree of surface hardness when quenched, the difficulty of safe handling and waste disposal have presented severe problems.

Many attempts have been made to develop non-cyanide carburizing processes. For example, Freudenberg, U.S. Pat. No. 1,796,248, describes a process using a mechanically agitated fused chloride salt bath with soda and finely divided carbon to introduce carbon into ferrous metal parts immersed therein. Leininger et al., U.S. Pat. No. 2,568,860, describes a similar bath using fused chloride and a carbonate; and instead of mechanical agitation, carbon monoxide or a gas forming carbon monoxide is bubbled through the bath. Further, Newell, U.S. Pat. No. 3,488,233, describes the use of molten lithium carbonate as the active carburizing ingredient. However, these methods using carbonates, generally tend to de-carburize initially and require a long interval of induction, or heating at high temperatures.

Other types of non-cyanide carburizing processes are described in Holt U.S. Pat. No. 2,049,806; Muller, U.S. Pat. No. 3,194,696 and Jakubowski et al U.S. Pat. No. 4,268,323. These processes involve the addition of organic nitrogen compounds such as urea, cyanates and dicyanodiamide. Such baths introduce both carbon and nitrogen into the treated parts, and in many applications, nitriding is not desired.

Other non-cyanide carburizing baths using metal carbides in molten salt are described in Albrect, U.S. Pat. No. 1,992,931; Solakian, U.S. Pat. No. 2,249,581; Steigerwald, U.S. Pat. No. 2,254,328 and British Patent No. 1,223,952. Among the metal carbides described, silicon carbide is preferred for good carburization. However, silicon carbide reacts with alkaline salts to form a silicate which is corrosive to steel and further gives rise to the objectionable formation of sludge or scum.

A further method is described in Leininger U.S. Pat. No. 2,492,803 which uses boron or silicon oxide in combination with carbonates and carbon to achieve carburizing. However, this method suffers from the same disadvantages as methods using silicon carbide.

More recent attempts to carburize by a non-cyanide liquid process are described in Foreman et al., U.S. Pat. No. 4,153,481 and Fox et al., Canadian Patent No. 944,665. Both of these patents describe processes using molten chloride and carbonate salt mixtures and graphite. However, as in prior attempts using carbon in the form of finely divided graphite, mechanical agitation is needed to disperse the graphite into the molten salt. This requires the modification of existing equipment used in cyanide baths, and requires large capital expenditures. Further, as stated previously for carbonate baths, a long interval of induction is required before carburization can by effected. For example, Foreman et al. U.S. Pat. No. 4,153,481 disclosed in Example 1 that about 5 hours of induction is needed. For the above reasons, cyanide processing is still the generally used molten salt carburizing method despite its many obvious disadvantages.

Therefore, it is the object of the present invention to develop a non-cyanide molten salt bath capable for producing a uniform depth of carbon casing free of nitrogen on ferrous metal surfaces.

Another object of the present invention is to provide a non-cyanide carburizing process capable of carburizing at a rate equal to or faster than the conventional cyanide process.

A further object of the invention is to provide a carburizing process employing readily available materials which are economical, require no special handling and create no waste disposal problems.

Yet another object of the present invention is to provide a carburizing process which can utilize equipment currently employed in cyanide processing.

BRIEF DESCRIPTION OF THE INVENTION

In accordance with the present invention, a molten salt bath for carburizing ferrous metal surfaces is provided. The molten salt bath, maintained at a temperature of 900° C. to 1050° C., comprises, based on the weight of the bath:

(a) about 85–99% by weight of an alkali metal chloride or a mixture of alkali metal chlorides;

(b) about 0.25–8% by weight of an activator, consisting of an oxygen containing compound of strontium or barium; and (c) sufficient amount of finely divided graphite to provide a continuous cover on the surface of the molten salt mixture.

The process according to the present invention comprises:

(a) melting and heating the salt bath composition to a temperature in the range of about 900° C. to about 1050° C.;

(b) maintaining the bath at this temperature for about 1 hour; and (c) immersing a ferrous metal article in the bath.

DETAILED DESCRIPTION OF THE INVENTION

In accordance with the present invention, a noncyanide carburizing molten salt bath operated at a temperature in the range of 900° C.–1050° C. may be prepared, based on the total weight of the bath, to comprise:

(a) about 85–99% by weight of an alkali metal chloride or a mixture of alkali metal chlorides;

(b) about 0.25–8% by weight of an activator consisting of an oxygen containing compound of barium or strontium; and (c) sufficient amount of a finely divided graphite material to provide a continuous cover on the surface of the molten salt mixture.

The alkali metal chloride may be sodium, potassium or lithium chloride used individually or in combination with one another. Preferably, the alkali metal chloride is a mixture of sodium and potassium chlorides, and most preferably, a 50:50 by weight mixture of sodium and potassium chlorides.

Compounds useful as an activator are selected from oxygen containing compounds of barium or strontium. The oxygen containing compound of barium or strontium suitable as activators should produce the corresponding oxides of barium or strontium on being calcined, such as: the oxides, the hydrated chlorides, or carboxylates of barium and strontium. The preferred compounds suitable as activators are the oxides or oxalates of barium or strontium, especially preferred is strontium oxalate.

The graphite used in the process according to the invention should be of standard industrial quality and finely divided, i.e. with a particle size between about 80 mesh and about 300 mesh. Especially preferred is a graphite known as Carbon 1264 available from Asbury Graphite Mills, Inc., New Jersey. The amount of graphite according to the present invention, should be sufficient to provide a continuous cover over the molten salts. Generally, about 1% is sufficient initially. However, for a newly prepared molten salt mixture, during the induction period, more graphite may need to be added to maintain a continuous cover on the surface of the molten salt mixture. It has been found that about 3% to about 8% by weight of additional graphite has been found to be satisfactory. Further, during carburizing, the graphite is consumed and more graphite is needed to continuously cover the molten salt mixture with a layer of graphite such that no molten salt surface is exposed. In a typical work day, approximately 1–3% by weight, based on the weight of the bath, of additional graphite is required, It was found that the bath can be continuously used for about 9–10 working days as long as more graphite, about 1% to 3% by weight, is added every day. The bath can then be reactivated by adding another allotment of the activator.

The bath should be operated at a temperature in the range of about 900° C.–1050° C. It has been found that for efficient and effective, i.e. optimum, carburization, the temperature of the bath is critical, and is dependent on the type of chloride and amount of activator in the bath. If potassium chloride is used together with about 2% strontium oxalate, the temperature of the bath may be lower. At about 900° C., it takes approximately 6 hours of immersion to achieve a Rockwell hardness of Rc 60-67; at 925° C., it takes about 4 hours of immersion to achieve a Rockwell hardness of Rc 64-67; and at 950° C., it takes about 2 hours of immersion to achieve a Rockwell hardness of Rc 63-67. However, if the molten salt is a mixture of sodium and potassium chloride, in particular a 50-50 mixture with about 1% strontium oxalate, then the temperature of the bath should be higher, the optimum temperature being 950° C. It has been observed at times that when the bath is operating optimally, the gases on the surface of the bath tends to flare into flame, similar in appearance to that observed in conventional cyanide baths.

It has been found, surprisingly, that in a bath according to the present invention, the need of agitation, to disperse the graphite particles in the bath to obtain satisfactory carburization, has been eliminated.

The present invention is described in further detail in the following examples. It will be understood that the examples are included for illustrative purposes only and no limitation is intended or implied therein.

EXAMPLE 1

A mixture of the following was prepared:

| | % by weight |
|---|---|
| Sodium chloride | 48.89 |
| Potassium chloride | 48.83 |
| Strontium oxide | 1.34% |
| Graphite | 1.00% |

The above mixture was heated in an Inconel pot to 950° C., and held at this temperature for about an hour. Six panels, 2"×3"×x3/64", of SAE 1010 steel, cleaned and weighed were immersed in the bath. Two of the panels were immersed for 1 hour, removed and immediately cold water quenched. These panels were reweighed and showed an average gain in weight of 82.9 mg and an average Rockwell hardness of Rc 40. The other four panels were immersed for 2 hours, removed and immediately cold water quenched. These four panels were also reweighed and showed an average gain in weight of 200.5 mg and an average Rockwell hardness of Rc 66. The amount of graphite added to provide a continuous cover on the bath was about 7% over a 6 hour period. One of the panels was etched with 10% hydrochloric acid with 0.2% diethylthiourea. The solution was analyzed by atomic absorption and the presence of strontium was indicated.

EXAMPLE 2

A mixture of the following composition was prepared and heated to 950° C. in an Inconel pot, and held at this temperature for about an hour.

| | % by weight |
|---|---|
| sodium chloride | 24% |
| potassium chloride | 74% |
| strontium oxalate | 1% |
| graphite | 1% |

The amount of graphite added over a period of 6 hours was about 4%. Six SAE 1010 panels with the same dimension as Example 1 were cleaned and weighed and immersed in the bath. Two panels were removed after 1 hour and immediately water quenched. These two panels showed an average gain in weight of 94 mg and an average Rockwell hardness of Rc 45. Four panels were removed after two hours and water quenched. These four panels showed an average weight gain of 187.8 mg. and an average Rockwell hardness of Rc 65.

EXAMPLE 3

A mixture of the following composition was prepared:

| | % by weight |
|---|---|
| potassium chloride | 97% |
| sodium chloride | 1% |
| strontium oxalate | 1% |

-continued

| | % by weight |
|---|---|
| graphite | 1% |

The mixture was molten and heated to a temperature of 900° C. in an Inconel pot and held at this temperature for one hour. A total of 4% graphite was added over a period of 6 hours. Four panels of SAE 1010 steel with the same dimensions were cleaned and weighed and immersed in the bath. One panel was removed after 1 hour, one panel was removed after 2 hours, one panel was removed after 4 hours and the last panel was removed after 6 hours. All of the panels were immediately quenched with cold water. The results obtained are as follows: the first panel after one hour immersion showed a weight gain of 24.5 mg. and a Rockwell hardness of Ra 47-75. The second panel with two hours immersion showed a weight gain of 53.7 mg. and a Rockwell hardness of Ra54-85. The Rockwell hardness on the C scale could not be measured. The third panel with four hours immersion showed a weight gain of 107.6 mg and a Rockwell hardness of Rc 35-66. The fourth panel with six hours immersion showed a weight gain of 179.9 mg and a Rockwell hardness of Rc 60-67.

EXAMPLE 4

A mixture of the following composition was prepared and heated to 950° C. in a mild steel pot. The molten salt mixture was held at this temperature for 1 hour.

| | % by weight |
|---|---|
| sodium chloride | 49% |
| potassium chloride | 49% |
| strontium oxalate | 1% |
| graphite | 1% |

The amount of graphite added over a period of 6 hours was about 2%.

An object made of SAE 1018 steel was immersed in the bath at 950° C. for 2 hours and brine quenched. The results showed a case depth of 0.024" microscopically and a Rockwell hardness of Rc 62.

EXAMPLE 5

A mixture of the following composition was prepared and heated to 950° C. in an Inconel pot and held at this temperature for about 1 hour.

| | % by weight |
|---|---|
| Sodium chloride | 49% |
| potassium chloride | 49% |
| barium oxide | 1% |
| graphite | 1% |

2% more graphite was added over a 5 hour period. Two SAE 1010 steel panels, 2"×3"x3/64", immersed in the bath for 1 hour and then water quenched, showed an average weight gain of 109 mg. and an average Rockwell hardness of Rc 53. Two identical panels immersed in the bath for 2 hours showed an average weight gain of 180 mg. and an average Rockwell hardness of Rc 65.

EXAMPLE 6

A mixture of the following composition was prerared and heated to 950° C. in an Inconel pot and held at this temperature for about 1 hour.

| | % by weight |
|---|---|
| sodium chloride | 48.75% |
| potassium chloride | 48.75% |
| barium oxalate | 1.5% |
| graphite | 1.0% |

3% of graphite was added over a period of 4 hours. Two SAE 1010 steel panel, 2"×3"×3/64", immersed in the bath at 950° C. for 1 hour followed by a cold water quench showed an average gain in weight of 104.8 mg. and an average Rockwell hardness of Rc 49-53. Two identical panels, immersed for 2 hours followed by a cold water quench showed an average gain in weight of 179.5 mg. and an average Rockwell hardness of Rc 65.

EXAMPLE 7

A mixture of the following composition was prepared for comparison:

| | % by weight |
|---|---|
| sodium chloride | 49% |
| potassium chloride | 49% |
| calcium carbonate | 1% |
| graphite | 1% |

The bath was heated to 950° C. and held at this temperature for about 1 hour. Five soft steel panels were immersed in the bath for 2 hours followed by a cold water quench. These showed an average weight gain of 147.5 mg. and an average Rockwell hardness of Rc 56. Further, the readings were widely scattered in the range of Rc 39-67.

EXAMPLE 8

A mixture of the following composition was prepared for comparison purposes.

| | % by weight |
|---|---|
| sodium chloride | 49.16% |
| potassium chloride | 49.16% |
| sodium carbonate | 0.68% |
| graphite | 1.00% |

The composition was heated to 925° C. and held at this temperature for about 1 hour. Four panels, SAE 1010 steel, 2"×3"×3/64", were cleaned and weighed and immersed in the bath for 2 hours. The panels were removed and quenched in cold water. The treated panels showed an average weight loss of 48.1 mg. with an average Rockwell hardness of Rc 26, the readings being widely scattered in the range of Rc 18-32.

EXAMPLE 9

For comparison purposes, two test bars, one made of 1117 steel and one made of 1018 steel, were treated in a conventional cyanide bath at 950° C. Two identical test bars were treated by the process using strontium oxalate according to the present invention, also at a temperature of 950° C. all of the test bars were immersed for 2 hours, removed, cooled, and the depth of carburization measured. The depth of carburization was measured by making successive 0.005" cuts of the surface of the test bars. Each 0.005" layer was analyzed for percent by weight of carbon. The results obtained are as follows:

| Depth of Carburization | % Carbon | | | |
|---|---|---|---|---|
| | Cyanide Process | | Present Process | |
| Pass No. | 1117 Steel | 1018 Steel | 1117 Steel | 1018 Steel |
| 1 | 0.731 | 0.687 | 0.796 | 0.674 |
| 2 | 0.665 | 0.750 | 0.794 | 0.575 |
| 3 | 0.545 | 0.644 | 0.630 | 0.483 |
| 4 | 0.464 | 0.625 | 0.537 | 0.374 |
| 5 | 0.371 | 0.436 | 0.365 | 0.327 |
| 6 | 0.300 | 0.349 | 0.319 | 0.267 |
| 7 | 0.247 | 0.303 | 0.278 | 0.251 |
| 8 | 0.207 | 0.292 | 0.221 | 0.229 |

The above data indicates that the molten bath composition and process according to the present invention is far superior to the known non-cyanide molten baths using carbonate. Further, the results obtained for Example 9 also shows that the non-cyanide process according to the present invention is comparable or better than the conventional cyanide process.

All of the percentages in the claims are in % by weight based on the total weight of the composition.

We claim:

1. A process for carburizing ferrous metal objects consisting essentially of the following process steps:

(a) mixing a composition comprising about 85–99% alkali metal chloride or a mixture of alkali metal chlorides; 0.25–8% of an activator, an oxygen containing compound selected from the group consisting of barium and strontium; and sufficient amount of, finely divided graphite to provide a continuous cover over the molten salt mixture;

(b) melting and heating the mixture to a temperature in the range of about 900° C.–1050° C.;

(c) maintaining the temperature for about 1 hour;

(d) immersing said ferrous metal objects in the bath for a period of time to achieve the desired degree of carburization.

2. A process according to claim 1 wherein the temperature of the bath is 950° C.

3. A process according to claim 1, wherein the immersion period is 2 hours.

4. A process according to claim 1 wherein the composition comprises about 89% to about 98% of a 75:25 by weight mixture of sodium chloride and potassium chloride; about 0.5% to about 5% of activator added as strontium oxalate and sufficient amount of finely divided graphite to provide a continuous cover on the molten salt mixture.

5. A process according to claim 1 wherein the composition comprises about 98% of a 50:50 mixture by weight of sodium chloride and potassium chloride; about 1% of activator added as strontium oxalate and about 1% of graphite.

6. An article of manufacture, a ferrous metal article, carburized in accordance with the process of claim 4, characterized by a greater concentration of carbon in the surface of the article than in the core and further characterized by having a strontium enriched surface.

* * * * *